US007096796B2

(12) United States Patent
Rosencrantz et al.

(10) Patent No.: US 7,096,796 B2
(45) Date of Patent: Aug. 29, 2006

(54) BRAKE HANDLE WITH INTEGRAL POSITION SENSING SWITCH

(75) Inventors: William R. Rosencrantz, Sarasota, FL (US); Eric C. Wright, Evans Mills, NY (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/376,364

(22) Filed: Feb. 28, 2003

(65) Prior Publication Data

US 2004/0168606 A1 Sep. 2, 2004

(51) Int. Cl.
*G05G 1/00* (2006.01)

(52) U.S. Cl. ..... 105/463.1; 74/523; 303/20

(58) Field of Classification Search ..... 200/61.87, 200/527, 564, 571, 14; 74/526, 519, 523, 74/473.31, 469, 471 XY, 495, 527; 303/20; 188/158; 477/92, 182; 105/463.1
See application file for complete search history.

(56) References Cited

U.S. PATENT DOCUMENTS 1,489,598 A * 4/1924 Hinman ..... 303/19
1,763,120 A * 6/1930 Aspinwall ..... 303/20
1,774,787 A * 9/1930 Clifford ..... 246/183
1,900,403 A * 3/1933 Grondahl ..... 246/63 C
1,901,047 A 3/1933 Sorensen
2,021,799 A * 11/1935 McNeal ..... 303/15
2,132,935 A * 10/1938 Bush ..... 303/56
2,897,011 A * 7/1959 Cotter ..... 303/16
2,974,268 A * 3/1961 Blake et al. ..... 388/838
3,612,882 A 10/1971 Sheppard
4,175,638 A 11/1979 Christensen
4,183,257 A * 1/1980 Lovenduski ..... 74/473.21
4,519,266 A * 5/1985 Reinecke ..... 74/471 XY
4,652,057 A 3/1987 Engle et al.
4,795,902 A * 1/1989 Kitaue ..... 250/231.13
4,865,278 A 9/1989 Kitaue
4,887,483 A 12/1989 Vollath
4,901,953 A 2/1990 Munetika
5,086,641 A 2/1992 Roselli
5,300,031 A 4/1994 Neer et al.
5,303,157 A 4/1994 Root et al.
5,415,465 A 5/1995 Skantar et al.
5,519,299 A * 5/1996 Ferri et al. ..... 318/640
5,571,999 A * 11/1996 Harris ..... 200/565
5,721,683 A 2/1998 Joyce, Jr. et al.
5,907,976 A 6/1999 Santoro, Jr. et al.

(Continued)

FOREIGN PATENT DOCUMENTS

EP 0 367 943 A2 5/1990

OTHER PUBLICATIONS

Brake Valve Controller W/Vent Valve, Parts Catalog, New York Air Brake Corporation, Jan. 2001 Supersedes Jun. 1999, pp. 1-31.

*Primary Examiner*—Mark T. Le
(74) *Attorney, Agent, or Firm*—Trevor B. Joike

(57) ABSTRACT

A brake handle for a train or other vehicle has a grip that may be grasped by a human operator, a shaft that is fastened to the grip, a hub that is fastened to the shaft and is rotated by the shaft, a mounting block that is supported by the hub for rotating movement, and a switch. The switch has a switch operator (such as a board provided with metal traces) supported by the hub and a switch contact supported by the mounting block.

25 Claims, 3 Drawing Sheets

U.S. PATENT DOCUMENTS 6,085,608 A * 7/2000 Santoro et al. ..... 74/471 XY
6,286,911 B1 9/2001 Wright et al.
6,338,288 B1 * 1/2002 Spadaccini et al. ..... 74/529
6,424,245 B1 * 7/2002 Rector et al. ..... 335/220
6,718,842 B1 * 4/2004 Bofias ..... 74/473.33
2002/0149565 A1 10/2002 Sako

* cited by examiner

BRAKE HANDLE WITH INTEGRAL POSITION SENSING SWITCH

TECHNICAL FIELD OF THE INVENTION

The present invention relates generally to a novel and improved brake handle for vehicles such as rail vehicles.

BACKGROUND OF THE INVENTION

Prior art brake equipment for locomotives has typically been implemented with mechanical and pneumatic hardware. Such hardware has included various valves interconnected by a system of pneumatic pipes. At least one of the valves responds to movement by the train operator of a brake handle so as to regulate the pressure in a brake pipe in order to apply and release the brakes of the locomotive, the brakes of any additional locomotives, and/or the brakes of cars powered by the locomotive or locomotives.

Usually, the brake handle has a number of positions, such as the brake release position and the full brake position at the opposite ends of the travel of the brake handle. The brake handle moves between the brake release position and the full brake position through a number of intermediate positions sometimes referred to as the application zone.

Current brake handles use a system of gears and/or linkages to transmit the position of the handle to external sensors that sense the position of the handle. These sensors may be valves, as described above, or mechanical, optical, or magnetic switches or other devices that sense the position of the brake handle. Thus, as the operator moves the brake handle, the external sensors determine the position of the brake handle in order to appropriately operate the brake system. The use of external sensors consumes too much space and adds to the cost and complexity of the braking system.

The present invention overcomes one or more of these or other problems of known brake handles.

SUMMARY OF THE INVENTION

According to one aspect of the present invention, a handle comprises a grip arranged to be grasped by a human operator, a shaft fastened to the grip, a hub fastened to the shaft and arranged to be moved rotationally by the shaft, a stationary mounting block supporting the hub for movement, and a switch. The switch has a switch contact and a switch operator. One of the switch contact and the switch operator is supported by the hub, and the other of the switch contact and the switch operator is supported by the stationary mounting block.

According to another aspect of the present invention, a method of controlling a vehicle comprises the following: converting movement of a human operator to mechanical movement of a shaft; rotating a hub in response to the movement of the shaft, wherein the hub is attached to the shaft and is supported by a mounting block; and, determining rotation of the hub by a switch having a switch contact and a switch operator. One of the switch contact and the switch operator is supported by the hub, and the other of the switch contact and the switch operator is supported by the mounting block.

According to yet another aspect of the present invention, a brake handle comprises a moveable shaft, a moveable member fixedly fastened to the moveable shaft and arranged to be moved by the moveable shaft, a stationary member supporting the moveable member for movement, and a switch. The switch has a switch contact and a switch operator. One of the switch operator and the switch contact is attached to the moveable member, and the other of the switch operator and the switch contact is attached to the stationary member.

BRIEF DESCRIPTION OF THE DRAWINGS

These and other features and advantages will become more apparent from a detailed consideration of the invention when taken in conjunction with the drawings in which.

DETAILED DESCRIPTION

Figures 1, 2, 3, 4, 5:
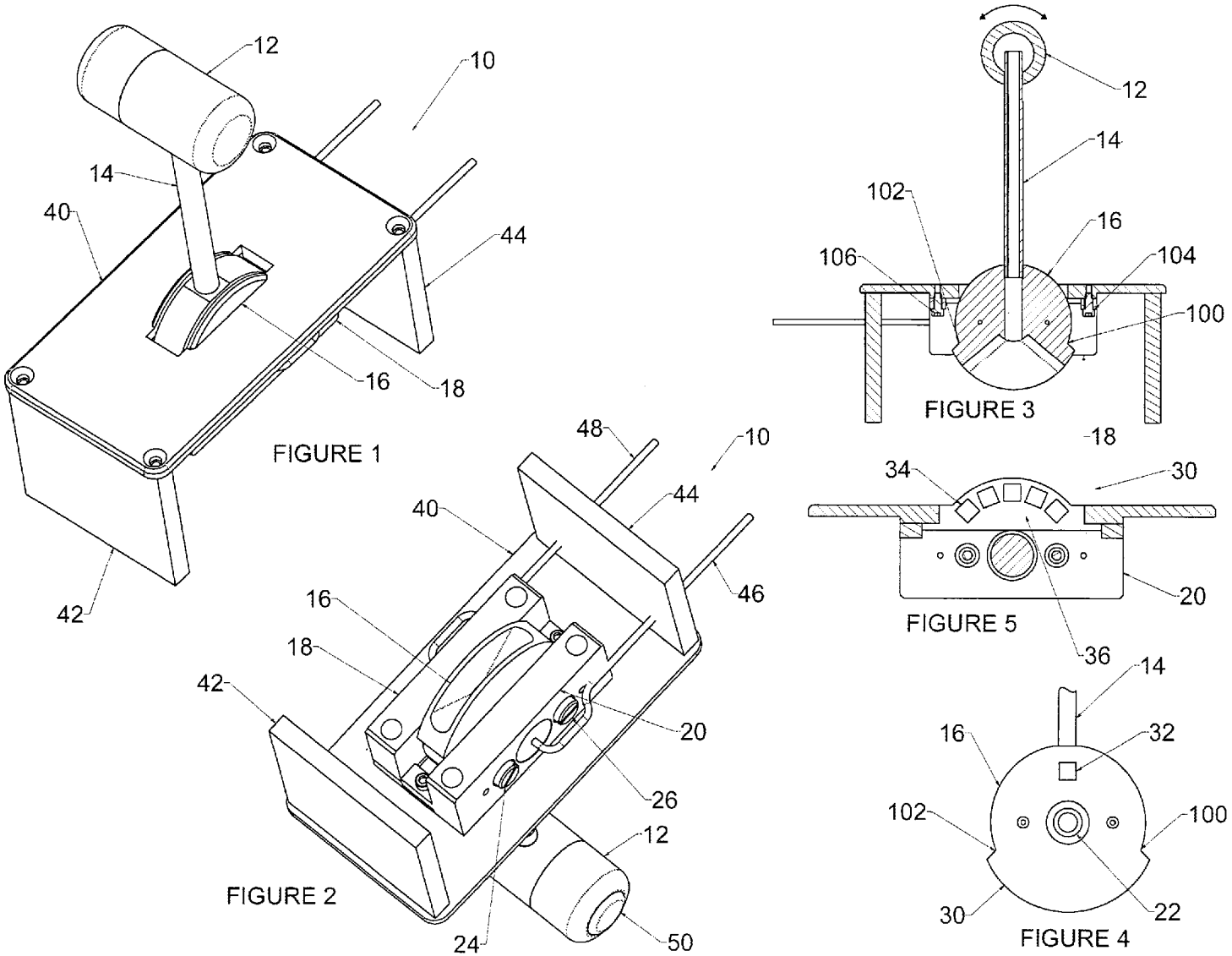
FIG. 1 is an isometric top view of a brake handle according to one embodiment of the present invention.
FIG. 2 is an isometric bottom view of the brake handle shown in FIG. 1.
FIG. 3 is a cross-section side view of a handle shaft and hub of the brake handle shown in FIGS. 1 and 2.
FIG. 4 is a side view of a portion of the handle shaft and hub of the brake handle of FIGS. 1–3.
FIG. 5 is a side view of a sensing board of the brake handle shown in FIGS. 1 and 2.

A brake handle 10 according to one embodiment of the present invention is shown in FIGS. 1–5 and includes a grip 12 that may be grasped by an operator in order to move the brake handle 10 to its various positions. The grip 12 is fastened to one end of a handle shaft 14 whose other end is appropriately fastened to a hub 16. The hub 16 is supported by bearings (not shown) to a pair of mounting blocks 18 and 20 through a hub shaft 22. Accordingly, as an operator grasps the grip 12 and moves the handle shaft 14 as shown by the arrow of FIG. 3, the hub 16 rotates on the hub shaft 22.

A force adjustment device 24 fitted through the mounting block 20 applies a restraining force on the hub 16 so as to adjust the force required to move the handle shaft 14 and rotate the hub 16. The force adjustment device 24, for example, may be a set screw that is threaded through the mounting block 20 and that engages the hub 16. For redundancy or otherwise, an additional force adjustment device 26 may also be provided through the mounting block 20 to adjust the force required to move the handle shaft 14 and rotate the hub 16.

An internal sensor 30 is provided in the area of the hub 16 and the mounting block 20 in order to sense the position of the hub 16 as the handle shaft 14 rotates the hub 16. The internal sensor 30 may be any type of sensor that can sense the rotation of the hub 16 and that can provide an appropriate signal corresponding to the rotation. For example, the internal sensor 30 may be a magnetic sensor including a magnet 32 mounted to one side of the hub 16 and a plurality of Hall sensors 34 mounted on a stationary board 36 fixed to the mounting block 20. The board 36, for example, may be a printed circuit board that supports electronics (not shown) that receive and process signals from the Hall sensors 34 in order to provide one or more output signals to appropriately control the brakes of a train on which the brake handle 10 is used.

Alternatively, the internal sensor 30 could be a potentiometer type sensor with a wiper contact on one of the hub 16 and the board 36 and a resistive element on the other of the hub 16 and the board 36. As a still further alternative, the internal sensor 30 could be an optical sensor with a light source on one of the hub 16 and the board 36 and one or more light sensors on the other of the hub 16 and the board 36. As yet a further alternative, the internal sensor 30 could be implemented as one or more cam operated switches such that a cam is mounted on one of the hub 16 and the board 36 and one or more mechanical switches are mounted on the other of the hub 16 and the board 36. Moreover, the internal sensor 30 could be implemented according to the Spiral Technology of Scientific Generics The mounting blocks 18 and 20 are fastened to a plate 40 and the plate 40, in turn, is fastened to supports 42 and 44 that may be attached to appropriate equipment in the control cab of a locomotive or other vehicle. The output signals from the internal sensor 30 may be provided from the brake handle 10 over a line 46. For redundancy, an additional internal sensor, similar to the internal sensor 30, may be provided in the area of the hub 16 and the mounting block 18 in order to sense the position of the hub 16 as the handle shaft 14 rotates the hub 16. The additional internal sensor also may be any type of sensor that can sense the rotation of the hub 16. For example, the additional internal sensor may be a magnetic sensor such as an additional magnet mounted to the other side of the hub 16 and a plurality of additional Hall sensors mounted on an additional board fixed to the mounting block 18. The additional board, for example, may also be a printed circuit board that supports electronics (not shown) that receive and process signals from the additional Hall sensors in order to provide one or more output signals to appropriately control the brakes of a train on which the brake handle 10 is used.

Similarly, the additional internal sensor could alternatively be a potentiometer, an optical sensor, or cam operated switches as discussed above, and may be implemented according to the aforementioned Spiral Technology. The output signals from the additional internal sensor may be provided from the brake handle 10 over a line 48.

Furthermore, a push button 50 may be provided on the grip 12 to operate a switch such as a dead man switch (not shown).

Figure 7:
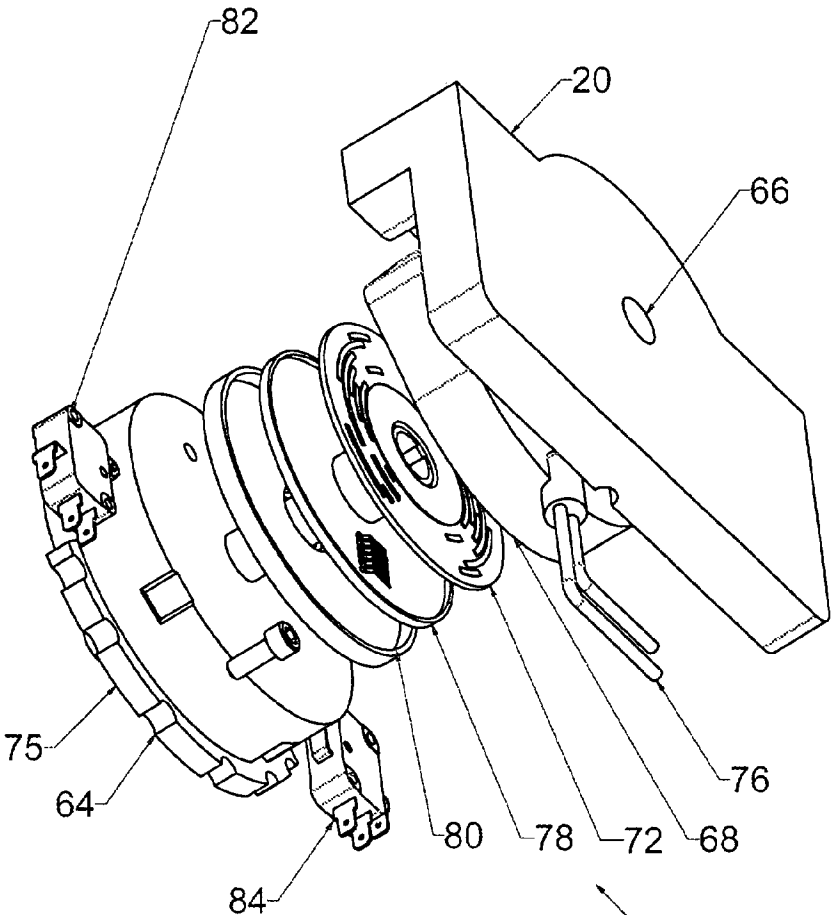
FIGS. 6 and 7 illustrate another embodiment of the present invention; and, FIG. 8 shows an operating environment for the brake handles of the present invention.
Figure 6:
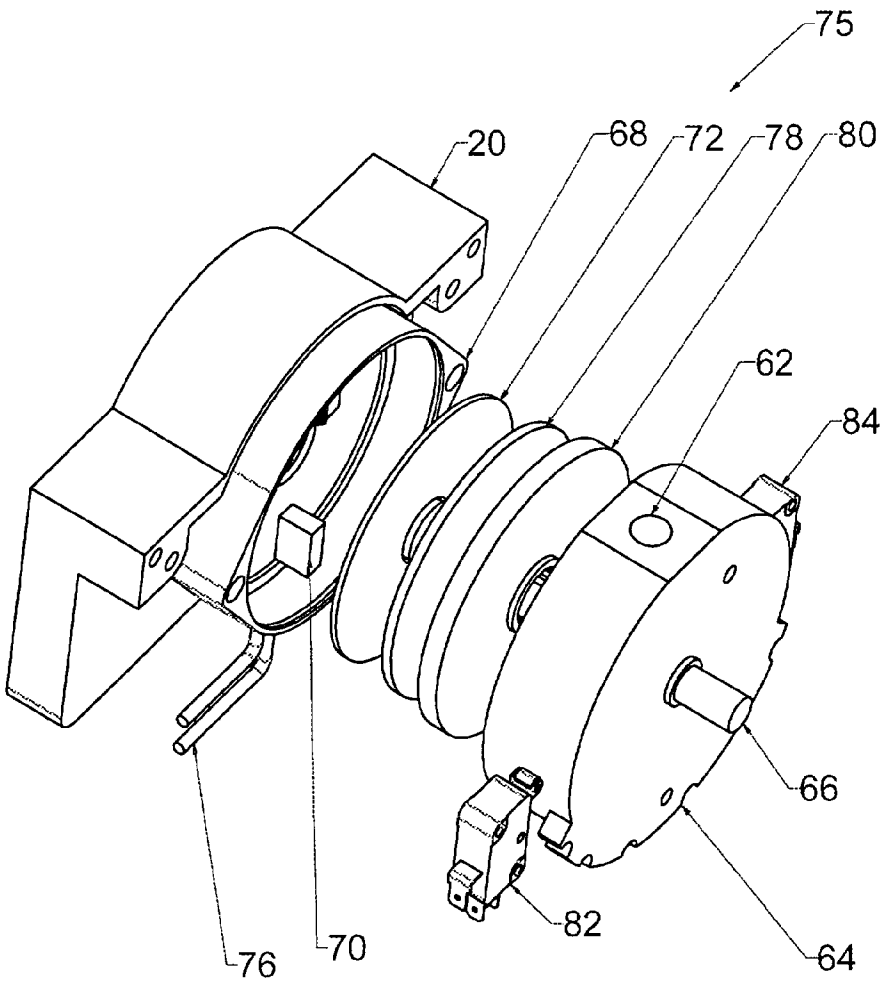

Another embodiment of a brake handle 60 is shown in FIGS. 6 and 7. The brake handles 10 and 60 may use some common elements and, therefore, the same reference numerals for these common elements are used in the description of the brake handle 60. Therefore, the handle shaft 14 may be received in a hole 62 of a hub 64 of the handle brake 60 so that the handle shaft 14 can be fastened to the hub 64. For example, the handle shaft 14 may be press fitted or threaded into the hole 62. The hub 64 is supported by bearings (not shown) to the mounting blocks 18 and 20 through a hub shaft 66. Accordingly, as an operator grasps the grip 12 and moves the handle shaft 14, the hub 64 rotates on the hub shaft 66.

A housing 68 is suitably fastened to the mounting block 20, and switch contacts 70 are fastened to the housing 68. Accordingly, neither the housing 68 nor the switch contacts 70 rotate as the hub 64 is rotated by the handle shaft 14. A rotating board 72 is attached to the hub shaft 66, and metal traces 74 are printed or otherwise formed on the rotating board 72 to establish current paths between selected ones of the switch contacts 70. Accordingly, the switch contacts 70 and the metal traces 74 form an internal sensor 75 of the brake handle 60. The current paths established by the switch contacts 70 and the metal traces 74 may be suitably output through a cable 76 so as to be received and processed in a manner to control braking of a train on which the brake handle 60 is used. The rotating board 72 is fastened to a rotating disk 78, and the rotating board 72 and the rotating disk 78 are housing in a rotating housing 80 that fits within the hub 64. The hub 64 may also act as a cam to operate stationary switches 82 and 84. The stationary switches 82 and 84, for example, may be limit switches.

Accordingly, as the operator grasps the grip 12 and moves the handle shaft 14 so as to rotate the hub 64, the rotating housing 80, the rotating disk 78, and the rotating board 72 also rotate commensurately. As the rotating board 72 rotates, one or more current paths are formed by the switch contacts 70 and the metal traces 74 in order to control braking and/or other functions of a train or other vehicle on which the brake handle 60 is used.

Alternatively, the internal sensor 75 may be a potentiometer type sensor with a wiper arm on one of the housing 68 and the rotating board 72 and a resistive element on the other of the housing 68 and the rotating board 72. As a still further alternative, the internal sensor 75 may be an optical sensor with a light source on one of the housing 68 and the rotating board 72 and one or more light sensors on the other of the housing 68 and the rotating board 72. Moreover, the internal sensor 75 may be implemented according to the aforementioned Spiral Technology.

Figure 8:
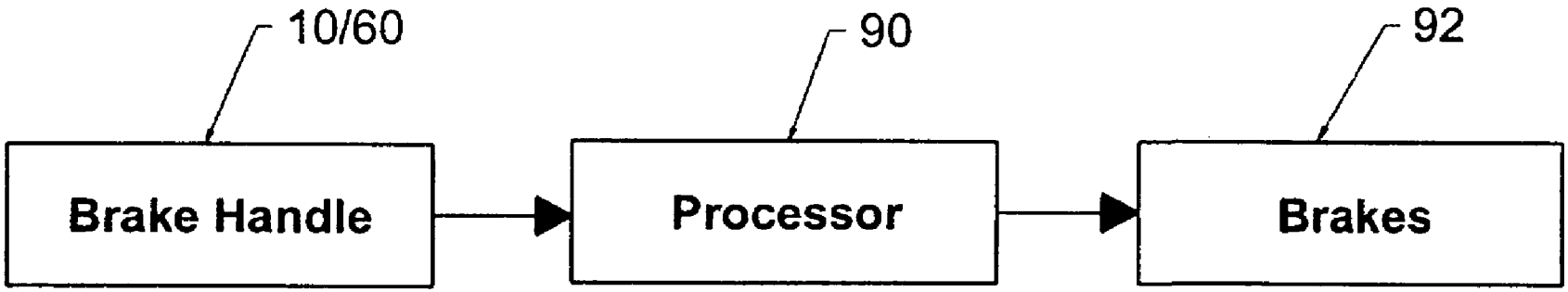

As discussed above and as shown in FIG. 8, the brake handles 10 and 60 may be used to control the brakes of a train or other vehicle. Thus, the brake handle 10/60 is coupled to a processor 90 that provides suitable outputs to control brakes 92 of a train or other vehicle. The processor 90 may be either internal or external to the brake handles 10 and 60.

Because the internal sensors 30 and 75 are mounted internally of the brake handles 10 and 60, no gears and/or linkages are required to couple the brake handles 10 and 60 to external sensors. As a result, the brake handles 10 and 60 are less complex and, therefore, more reliable than known brake handles. Also, the brake handles 10 and 60 are less costly than known brake handles. Moreover, the brake handles 10 and 60 use considerably less space in the control cab of a locomotive or other vehicle than known brake handles.

Certain modifications of the present invention have been discussed above. Other modifications will occur to those practicing in the art of the present invention. For example, the handles 10 and 60 are described above as brake handles. However, these handles can control functions other than braking and may, therefore, be referred to in the claims more generally. Alternatively or additionally, it is possible to use the handles 10 and 60 to control the speed and/or modes of a train or other vehicle.

Also, motion of the handle shaft 14 may be limited due to engagement by the handle shaft with the plate 40. Alternatively, the hub 16/64 may be provided with ridges 100 and 102 that engage corresponding stops 104 and 106 to limit motion of the handle shaft 14 and corresponding rotary motion of the hub 16/64. The stops 104 and 106 may be adjustable stops. For example, the stops 104 and 106 may be provided as adjustable screws.

Moreover, as discussed above, the internal sensor 30 may be provided redundantly as an additional internal sensor for the brake handle 10. Similarly, the internal sensor 75 may be provided redundantly as an additional internal sensor for the brake handle 60.

Furthermore, as described above, the hubs 16 and 64 are rotated on their corresponding hub shafts 22 and 66 in response to rotational movement of the handle 14. Alternatively, other forms of movement of the handle 14 and the hubs 16 and 64 may be provided. For example, the hubs 16 and 64 may be arranged to slide on their corresponding hub shafts 22 and 66 in response to sliding movement of the handle 14.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

We claim:

1. A handle comprising:

a grip arranged to be grasped by a human operator;

a shaft fastened to the grip;

a hub fastened to the shaft and arranged to be moved rotationally by the shaft, wherein the hub has a rotational axis about which the hub rotates, and wherein the shaft is perpendicular to the rotational axis;

a stationary mounting block supporting the hub for movement; and, a switch having at least first and second switch contacts, wherein the first switch contact is supported by the hub, wherein the second switch contact is supported by the stationary mounting block, wherein the first and second switch contacts are arranged to engage one another, and wherein the switch is coupled so as to control brakes of a vehicle.

2. The handle of claim 1 wherein the grip is fastened directly to one end of the shaft, and wherein an opposing end of the shaft is fastened directly to the hub.

3. The handle of claim 1 wherein the first switch contact comprises a board having a metal trace thereon, and wherein the second switch contact selectively engages the metal trace.

4. The handle of claim 1 wherein the first switch comprises a board having a plurality of metal traces thereon, and wherein the second switch contact comprises a plurality of contacts arranged to selectively engage the plurality of metal traces.

5. The handle of claim 1 further comprising processing equipment coupling the handle to the brakes of the vehicle.

6. The handle of claim 1 wherein the brakes comprise brakes of a train.

7. The handle of claim 1 wherein the shaft is supported by the hub for rotary movement.

8. A method of controlling a vehicle comprising:

converting movement of a human operator to mechanical movement of a non-electrical contact shaft;

rotating a hub in response to the movement of the shaft, wherein the hub is attached to the shaft and is supported by a mounting block and has an axis of rotation;

determining rotation of the hub by a switch having a switch contact and a switch operator, wherein the switch contact and the switch operator are displaced from one another axially but not radially with respect to the axis, wherein one of the switch contact and the switch operator is supported by the hub, wherein the other of the switch contact and the switch operator is supported by the mounting block, and wherein the first and second switch contacts controllably engage one another in response to rotation of the hub; and, controlling non-simulated braking of the vehicle in response to the sensing of rotation of the hub.

9. The method of claim 8 wherein the switch operator is attached to the hub, and wherein the switch contact is attached to the mounting block.

10. The method of claim 8 wherein the switch operator comprises a board having metal traces.

11. The method of claim 10 wherein the switch operator is attached to the hub, and wherein the switch contact is attached to the mounting block.

12. The method of claim 8 wherein the brakes comprise brakes of a train.

13. The method of claim 8 wherein the hub is attached to an end of the shaft opposite to an end moved by the human operator.

14. A valveless brake handle comprising:

a grip to be grasped by a human operator;

a moveable shaft directly attached to the grip;

a moveable member fixedly and directly fastened to the moveable shaft and arranged to be moved by the moveable shaft;

a stationary member supporting the moveable member for movement; and, a switch having a switch contact and a switch operator, wherein one of the switch operator and the switch contact is attached in a linkage free manner to the moveable member, wherein the other of the switch operator and the switch contact is attached to the stationary member, wherein the shaft and the moveable member operate only electrical apparatus that includes the switch, wherein the grip is affixed to one end of the moveable shaft and the moveable member is affixed to an opposing end of the moveable shaft, and wherein the handle is coupled so as to control brakes of a vehicle.

15. The valveless brake handle of claim 14 wherein the switch operator is attached to the moveable member, and wherein the switch contact is attached to the stationary member.

16. The valveless brake handle of claim 14 wherein the switch operator comprises a board having metal traces.

17. The valveless brake handle of claim 16 wherein the switch operator is attached to the moveable member, and wherein the switch contact is attached to the stationary member.

18. The valveless brake handle of claim 14 wherein the brake handle is coupled to the brakes of a vehicle.

19. The valveless brake handle of claim 18 wherein the brakes comprise brakes of a train.

20. The valveless brake handle of claim 19 wherein the switch operator is attached to the moveable member, and wherein the switch contact is attached to the stationary member.

21. The valveless brake handle of claim 19 wherein the switch operator comprises a board having metal traces.

22. The valveless brake handle of claim 21 wherein the switch operator is attached to the moveable member, and wherein the switch contact is attached to the stationary member.

23. The valveless brake handle of claim 19 further comprising adjustable stops to define first and second limits on the motion of the moveable shaft such that motion of the shaft is not permitted past the adjustable stops.

24. A valveless brake handle comprising:

a grip to be grasped by a human operator;

a moveable shaft directly attached to the grip;

a moveable member fixedly and directly fastened to the moveable shaft and arranged to be moved by the moveable shaft;

a stationary member supporting the moveable member for movement; and, a switch having a switch contact and a switch operator, wherein one of the switch operator and the switch contact is attached in a linkage free manner to the moveable member, wherein the other of the switch operator and the switch contact is attached to the stationary member, and wherein the shaft and the moveable member operate only electrical apparatus that includes the switch, wherein the moveable member is supported by the stationary member for rotary movement, and wherein the handle is coupled so as to control brakes of a vehicle.

25. The valveless brake handle of claim 24 wherein the shaft is supported by the moveable member for rotary movement.

* * * * *